United States Patent [19]

Haines et al.

[11] Patent Number: 4,738,239

[45] Date of Patent: Apr. 19, 1988

[54] IGNITION SYSTEM

[75] Inventors: David L. Haines, Greenwood; Daniel H. Hopper, Peru, both of Ind.

[73] Assignee: Delco Electronics Corporation, Kokomo, Ind.

[21] Appl. No.: 80,421

[22] Filed: Jul. 31, 1987

[51] Int. Cl.[4] ..... F02P 3/04

[52] U.S. Cl. ..... 123/651; 123/630; 123/643

[58] Field of Search ..... 123/415, 416, 417, 602, 123/605, 609, 618, 619, 620, 630, 643, 644, 650, 651, 652

[56] References Cited

U.S. PATENT DOCUMENTS

| | | | |
|---|---|---|---|
| 3,324,351 | 6/1967 | Pahl, Jr. | 123/652 X |
| 3,340,861 | 9/1967 | Schiff | 123/652 X |
| 4,164,706 | 8/1979 | Akita et al. | 123/619 X |
| 4,366,801 | 1/1983 | Endo et al. | 123/643 X |
| 4,369,758 | 1/1983 | Endo | 123/620 |
| 4,438,751 | 3/1984 | Iwasaki | 123/643 X |
| 4,441,479 | 4/1984 | Endo et al. | 123/620 X |
| 4,455,989 | 6/1984 | Endo et al. | 123/643 X |
| 4,627,398 | 12/1986 | Koike | 123/609 X |

*Primary Examiner*—Willis R. Wolfe
*Attorney, Agent, or Firm*—C. R. Meland

[57] ABSTRACT

An inductive ignition system for a spark ignited internal combustion engine. An N-channel field effect transistor (FET) is connected in series with the primary winding of an ignition coil. The primary winding and the FET are connected in a high side drive connection. An NPN transistor has its collector-emitter circuit connected between the gate and source of the FET. When the FET is biased off a flyback voltage is developed across the primary winding which is used to bias the NPN transistor conductive thereby clamping the gate and source voltage of the FET together to keep the FET switched off.

6 Claims, 1 Drawing Sheet

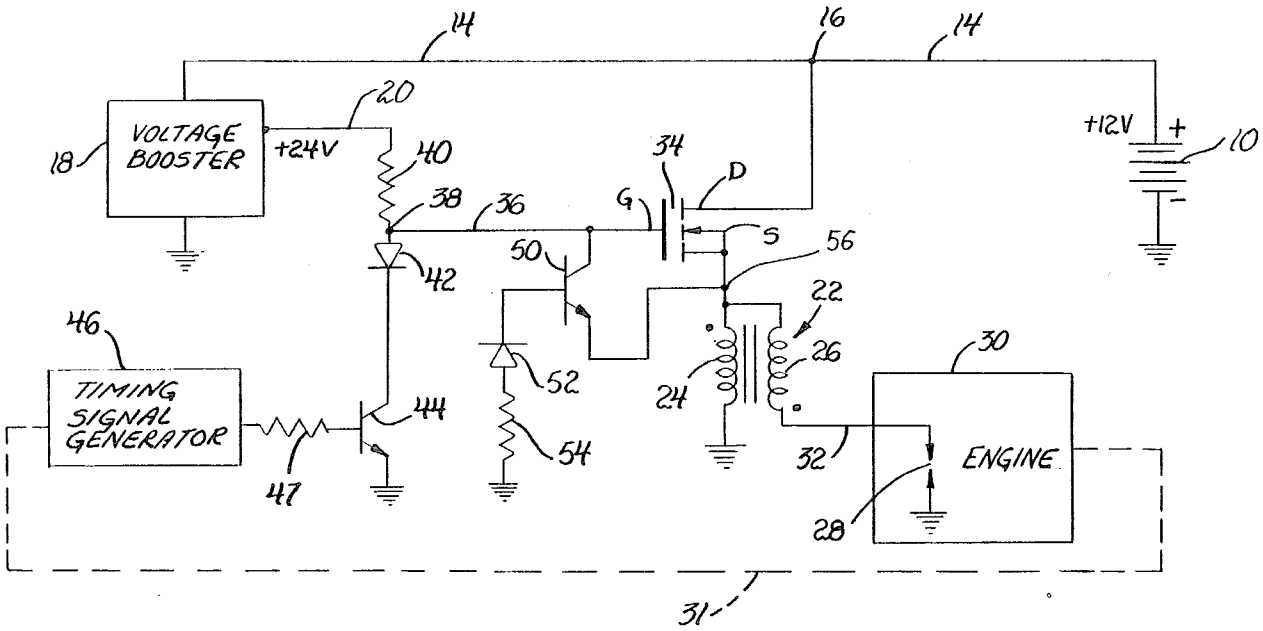
+12V
10
14
16
14
20
+24V
VOLTAGE BOOSTER
18
34
D
S
G
56
22
26
24
36
50
52
54
38
40
42
44
47
46
TIMING SIGNAL GENERATOR
30
ENGINE
28
32
31

IGNITION SYSTEM

This invention relates to ignition systems for spark-ignited internal combustion engines and more particularly to an ignition system wherein the primary winding of an ignition coil is connected to an N-channel field effect transistor (FET) in a high side drive connection.

Inductive ignition systems for spark-ignited internal combustion engines of a type wherein a transistor is connected in series with he primary of an ignition coil and wherein the transistor is switched on and off in synchronism with operation of the engine are well know. In one type of known system a pair of NPN transistors connected in a Darlington configuration are connected between the primary of the ignition coil and ground.

It would be desirable to be able to provide an ignition system wherein the device that switches primary winding current is an N-channel field effect transistor that is connected to the primary winding in high side drive connection, that is where the primary winding is connected between the source of the N-channel FET and ground. However, if an N-channel FET is connected to the primary winding of an ignition coil in a high side drive connection a problem of biasing the FET off or nonconductive exists. Thus, when the FET is biased on the voltage across the primary winding is positive at the end of the primary winding that is connected to the source of the FET and its grounded end is negative. When an attempt is now made to bias the FET off or nonconductive, the polarity of the voltage at the ends of primary winding reverses and develops a flyback voltage which drives the source of the FET negative. This flyback voltage slightly forward biases the FET until primary winding current is dissipated as heat. The result is a slow shut off of the FET and excessive heat generation in the primary of the ignition coil and in the FET. Further, the ignition coil may not generate a voltage that is high enough to fire a spark plug.

It accordingly is an object of this invention to provide an ignition system that uses an N-channel FET that is connected with the primary winding of an ignition coil in a high side drive connection that includes means for preventing the flyback voltage from biasing the FET on and which assures a sharp cut off of FET current. More specifically, the ignition system of this invention is provided with an NPN transistor which has its emitter connected to the source of the FET and its collector connected to the gate of the FET. The base and emitter of the NPN transistor are so connected with the primary winding of the ignition coil that when the flyback voltage occurs the NPN transistor is biased conductive to connect the gate and source of the FET. The gate and source voltages of the FET are now clamped together to maintain the FET off. The FET is maintained biased off before the flyback voltage becomes negative enough to forward bias the FET.

IN THE DRAWING

The single figure drawing illustrates an ignition system made in accordance with this invention.

Referring now to the drawing, the reference numeral 10 designates a source of direct voltage which is illustrated as a battery of a motor vehicle. The direct voltage source 10 is a 12 volt battery and it is charged by a conventional battery charging system which has not been illustrated. The negative terminal of direct voltage source 10 is connected to ground and its positive terminal is connected to conductor 14. Conductor 14 is connected to junction 16 and to the input of a voltage booster 18 or power supply that has a 12 volt input and a 24 volt output applied between conductor 20 and ground. The polarity of the 24 volt direct voltage output is such that conductor 20 is at a positive 24 volts relative to ground. The voltage booster 18 can take various forms and may be, for example, a DC to DC converter.

The ignition system has an ignition coil generally designated by reference numeral 22 that has a primary winding 24 and a secondary winding 26.

The secondary winding 26 is shown connected to one of the spark plugs 28 for an engine 30 by a conductor 32. The engine has additional spark plugs which have not been illustrated. In an ignition system that uses a rotor and a distributor cap and one ignition coil the secondary winding 26 would be sequentially connected to the spark plugs of the engine via the distributor rotor contact and the terminals of the distributor cap. In a so-called distributorless or direct ignition system each spark plug, like spark plug 28, is directly connected to a secondary winding of an ignition coil by a conductor like conductor 32. In a distributorless ignition system an ignition coil, like coil 22, is provided for each spark plug. Thus, if the engine 30 were a six cylinder engine with six spark plugs the system would have six ignition coils like coil 22, each individually connected to a spark plug in a manner illustrated in the drawing. From the foregoing it will be appreciated that this invention can be used in either a distributorless system or a system that has a rotor and a distributor cap. Further, the ignition system of this invention could be used in a direct or distributorless igntion system where there is one coil for two spark plugs and wherein a pair of spark plugs are fired in series from a secondary winding that is not electrically connected to the primary winding.

The ignition system has an N-channel enhancement mode field effect transistor (FET) 34 which has a drain D, a source S and a gate G. The FET 34 may be, for example, a Motorola type 20N50 N-channel enhancement mode metal oxide field effect transistor. The drain D is connected to junction 16 and hence to the positive terminal of direct voltage source 10. The source S is connected to one side of primary winding 24 and the opposite side of primary winding 24 is connected to ground.

The gate G of FET 34 is connected to conductor 36 which in turn is connected to junction 38. The positive 24 volts on conductor 20 is applied to a circuit that is comprised of resistor 40, diode 42 and the collector-emitter circuit of NPN transistor 44. The emitter of transistor 44 is connected to ground.

The base of transistor 44 is connected to a timing square-wave signal generator 46 which develops a square-wave voltage that is synchronized to the angular position of the crankshaft of engine 30. The signal generator may include a variable reluctance voltage generator having a pickup coil and a rotor driven by engine 30. Dotted line 31 represents the connection between the engine and the rotor of pulse generator 46. The voltage generated in the pickup coil is squared by a squaring circuit and the square-wave timing voltage is applied to the base of transistor 44 via resistor 47 to cause transistor 44 to switch on and off in synchronism with engine crankshaft rotation.

The ignition system has a semiconductor switching device which takes the form of an NPN transistor 50.

The base of transistor 50 is connected to ground via diode 52 and resistor 54. The collector of transistor 50 is connected to the gate G of FET 34. The emitter of transistor 50 is connected to junction 56 and accordingly is connected to the source of FET 34 and to one end of primary 24.

The operation of the ignition system of this invention will now be described. The transistor 44 is switched on and off in synchronism with engine crankshaft position. When transistor 44 is biased off the positive 24 volts on conductor 20 is applied to gate G of FET 34 via resistor 40, junction 38 and conductor 36. The gate G of FET 34 is now positive with respect to its source S by an amount sufficient to bias FET 34 on between its drain and source and maintain it on between its drain and source. With FET 34 biased on between its drain and source current is supplied to primary winding 24 from voltage source 10. The polarity of the voltage across primary 24 will now be positive at the end of primary 24 that is connected to junction 56 and negative at the end of primary 24 that is connected to ground.

When the spark plug 28 is to be fired the transistor 44 is biased conductive to cause FET 34 to be biased off thereby cutting off primary winding current and causing a voltage to be developed in secondary 26 that is high enough to cause a spark to be developed at the electrodes of spark plug 28.

When transistor 44 is biased on, junction 38 goes from about 24 volts positive with respect to ground to about one volt positive with respect to ground. The FET 34 requires a threshold voltage from gate to source of about three to five volts to maintain it conductive and since the voltage at junction 38 and the gate of FET 34 has now dropped to about one volt the FET 34 is biased off and the current to primary winding 24 is interrupted. This causes a flyback voltage to be developed in primary 24 which is negative at its end that connected to junction 56. Before this flyback voltage can become negative enough to forward bias FET 34 (about −2 to −4 volts) diode 52 and the base-emitter circuit of transistor 50 is forward biased to switch transistor 50 on between its collector and emitter. Putting it another way, the flyback voltage biases transistor 50 conductive before the flyback voltage can bias FET 34 on. With transistor 50 on, the gate and source of FET 34 are connected by transistor 50 to thereby clamp the gate-source voltage to keep FET 34 off. Thus, the source voltage is now only lower than the gate voltage by the small voltage drop across the collector and emitter of transistor 50 and this voltage difference is not enough to bias FET 34 on but rather maintains FET 34 biased off. Diode 52 and transistor 50 are free to float negative with the gate and source of the FET 34 leaving resistor 54 as the only component with the high voltage across it.

The purpose of diode 42 is to block the high negative flyback voltage to protect transistor 44.

It will be appreciated that if the circuit did not use transistor 50, diode 52 and resistor 54, the flyback voltage developed across primary winding 24 would bias FET 34 back on after it is biased off due to the fact that the flyback voltage would drive the source of FET 34 sufficiently negative to bias it on. Further, it can be seen that the flyback voltage itself is used as a trigger voltage to turn transistor 50 on and thereby prevent the flyback voltage from turning on FET 34.

It has been pointed out that the FET 34 could be a Motorola type 20N50 enhancement mode metal oxide field effect transistor. The device 34 can take other forms as long as the device has the characteristics of an N-channel enhancement mode field effect transistor.

The voltage of the source 10 can be other than 12 volts. By way of example, the source 10 could be a 6 volt or a 24 volt source. The voltage booster 18 must be capable of boosting the voltage to about 12 to 18 volts above the voltage of the voltage source 10 in order to assure that FET 34 will remain biased on once it is biased on. Thus, if source 10 were a 24 volt source, booster 18 would boost the voltage on conductor 20 to at least 36 volts.

The circuit for varying the bias voltage of FET 34 at junction 38 has been described as including switching transistor 44. This bias circuitry could take other forms.

It will be appreciated that diode 52 is a protection diode which blocks reverse current through the emitter of transistor 50.

The embodiments of the invention in which an exclusive property or privilege is claimed are defined as follows:

1. An ignition system for a spark ignited internal combustion engine comprising, a source of direct voltage having positive and negative terminals, an ignition coil having a primary winding and a secondary winding, an N-channel semiconductor device having a gate, a drain and a source, means connecting the positive terminal of said direct voltage source to said drain, means connecting said primary winding between said source of said N-channel semiconductor device and the negative terminal of said direct voltage source, a semiconductor switch means connected between said gate and source of said N-channel semiconductor device, said semiconductor switch means when conductive connecting said gate and source of said N-channel semiconductor device, means for biasing said N-channel semiconductor device on and off, said primary winding developing a flyback voltage that is negative at its end that is connected to said source of said N-channel semiconductor device when said N-channel semiconductor device is biased off, and means for causing said semiconductor switch means to be biased conductive in response to the development of said flyback voltage to thereby maintain said N-channel semiconductor device off.

2. The ignition system according to claim 1 where said N-channel semiconductor device is an N-channel enhancement mode field effect transistor.

3. An ignition system for a spark ignited internal combustion engine comprising, a source of direct voltage having positive and negative terminals, an ignition coil having a primary winding and a secondary winding, an N-channel field effect transistor having a gate, a drain and a source, means connecting the positive terminal of said direct voltage source to said drain, means connecting said primary winding between said source of said transistor and the negative terminal of said direct voltage source, an NPN transistor having a base, a collector and an emitter, means connecting said collector of said NPN transistor to said gate of said field effect transistor, means connecting the emitter of said NPN transistor to said source of said field effect transistor, means for biasing said field effect transistor on and off, said primary winding developing a flyback voltage that is negative at its end that is connected to said source of said field effect transistor when said field effect transistor is biased off, and means for coupling said flyback voltage to the base of said NPN transistor to cause said NPN transistor to be biased conductive when said flyback voltage occurs, said NPN transistor when conductive connecting the gate and source of said field effect transistor to thereby maintain it off.

4. An ignition system for a spark ignited internal combustion engine comprising, a source of direct voltage having positive and negative terminals, said negative terminal of said direct voltage source connected to ground, an ignition coil having a primary winding and a secondary winding, an N-channel field effect transistor having a gate, a drain and a source, means connecting the positive terminal of said direct voltage source to said drain, means connecting one end of said primary winding to said source of said field effect transistor, means connecting the opposite end of said primary winding to ground, a semiconductor switch means connected between said gate and source of said transistor, said semiconductor switch means when conductive connecting said gate and source of said transistor, means for biasing said field effect transistor on and off, said primary winding developing a flyback voltage that is negative at its end that is connected to said source of said field effect transistor when said field effect transistor is biased off, and means coupling said flyback voltage to said semiconductor switch means to cause said semiconductor switch means to be biased conductive in response to the development of said flyback voltage to thereby connect that gate and source of said field effect transistor to maintain said field effect transistor off.

5. The ignition system according to claim 4 where said semiconductor switch means is an NPN transistor having its collector connected to said gate, its emitter connected to said source and its base connected to ground.

6. The ignition system according to claim 4 where said semiconductor switch means is an NPN transistor having its collector connected to said gate, its emitter connected to said source and its base connected to ground through a diode.

* * * * *